US006675908B1

(12) United States Patent
Frauhammer et al.

(10) Patent No.: US 6,675,908 B1
(45) Date of Patent: Jan. 13, 2004

(54) DRILLING HAMMER OR IMPACT HAMMER

(75) Inventors: Karl Frauhammer, Leinfelden-Echterdingen (DE); Frank Mueller, Deckenpfronn (DE); Gerhard Meixner, Filderstadt (DE); Heinz Schnerring, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/048,738

(22) PCT Filed: May 16, 2000

(86) PCT No.: PCT/DE00/01549

§ 371 (c)(1),
(2), (4) Date: May 2, 2002

(87) PCT Pub. No.: WO01/05558

PCT Pub. Date: Jan. 25, 2001

(30) Foreign Application Priority Data

Jul. 20, 1999 (DE) ..... 199 33 972

(51) Int. Cl.[7] ..... B25D 11/04

(52) U.S. Cl. ..... 173/48; 173/137; 173/210; 173/211; 173/201

(58) Field of Search ..... 173/91, 48, 137, 173/162.1, 206, 210, 211, 201

(56) References Cited

U.S. PATENT DOCUMENTS

| | | | | | |
|---|---|---|---|---|---|
| 1,896,992 | A | * | 2/1933 | Agren | 173/133 |
| 2,899,934 | A | * | 8/1959 | Salengro | 173/18 |
| 3,179,185 | A | * | 4/1965 | O'Farrell | 173/133 |
| 3,451,492 | A | * | 6/1969 | Ekstrom et al. | 173/162.2 |
| 3,592,275 | A | * | 7/1971 | Fletcher et al. | 175/317 |
| 3,724,560 | A | * | 4/1973 | Tibbott | 173/178 |
| 3,788,404 | A | | 1/1974 | Koudelka | |
| 4,102,410 | A | * | 7/1978 | Ross | 173/133 |
| 5,117,923 | A | * | 6/1992 | Wuhrer | 173/109 |
| 5,573,075 | A | | 11/1996 | Henry | |
| 5,626,199 | A | * | 5/1997 | Henry et al. | 173/211 |
| 5,678,641 | A | | 10/1997 | Manschitz | |
| 5,971,083 | A | * | 10/1999 | Wiklund | 173/19 |

FOREIGN PATENT DOCUMENTS

| | | |
|---|---|---|
| EP | 0 429 475 B1 | 9/1993 |
| WO | 90 01400 A | 2/1990 |

* cited by examiner

*Primary Examiner*—Scott A. Smith
*Assistant Examiner*—Chukwura H Nathaniel
(74) *Attorney, Agent, or Firm*—Michael J. Striker

(57) ABSTRACT

A drill hammer or riveter, includes a housing (11), in which a hammering mechanism (12) is accommodated that in an axially displaceably supported guide tube (13) has a reciprocating piston (16) and a striker (17), drivable by the piston (16) via an air cushion; the hammering mechanism (12) can be moved out of an idling position into a hammering position by an axial displacement of the guide tube (13); the guide tube (13) is urged by a restoring spring (27) in the direction of the idling position with a restoring force: and between the guide tube (13) and the housing (11), at least one damping and/or spring member (30, 36, 37) is provided, which in the hammering position of the guide tuber (13) has a spring or damping characteristic between the guide tube (13) and the housing (11) that deviates from the restoring spring (27) in the region of the idling position.

10 Claims, 3 Drawing Sheets

DRILLING HAMMER OR IMPACT HAMMER

PRIOR ART

The invention is based on a drill hammer or riveter as generically defined by the preamble to claim 1. From European Patent Disclosure EP-A 429 475, a drill hammer or riveter is known which has a guide tube supported axially displaceably in a housing. An axially reciprocating piston, which is coupled via an air cushion to a striker, is accommodated in the guide tube. A restoring spring urges the guide tube with a restoring force in the direction of a front outset position, in which the air cushion is ventilated via an opening in the guide tube, so that the hammering mechanism of the drill hammer or riveter goes into the idling mode and no further axial impacts are exerted on a tool. If the guide tube is forced axially rearward out of this position by the application of the drill hammer or riveter against a machining point counter to the prestressing force of the restoring spring, then the ventilation opening is closed, and the hammering mechanism enters the hammering position. In the riveting mode, via a riveting die the guide tube experiences reverse impacts, which are transmitted to the housing via the restoring spring. To the operator of the drill hammer or riveter, these reverse impacts are irritating, so that the attempt is made to avoid or reduce them as much as possible.

ADVANTAGES OF THE INVENTION

The drill hammer or riveter according to the invention having the characteristics of claim 1 has the advantage that the vibration caused by the hammering mechanism can be reduced in a relatively simple way.

By the provisions recited in the dependent claims, advantageous refinements of and improvements to the drill hammer or riveter according to the invention are possible.

DRAWINGS

Figure 1:
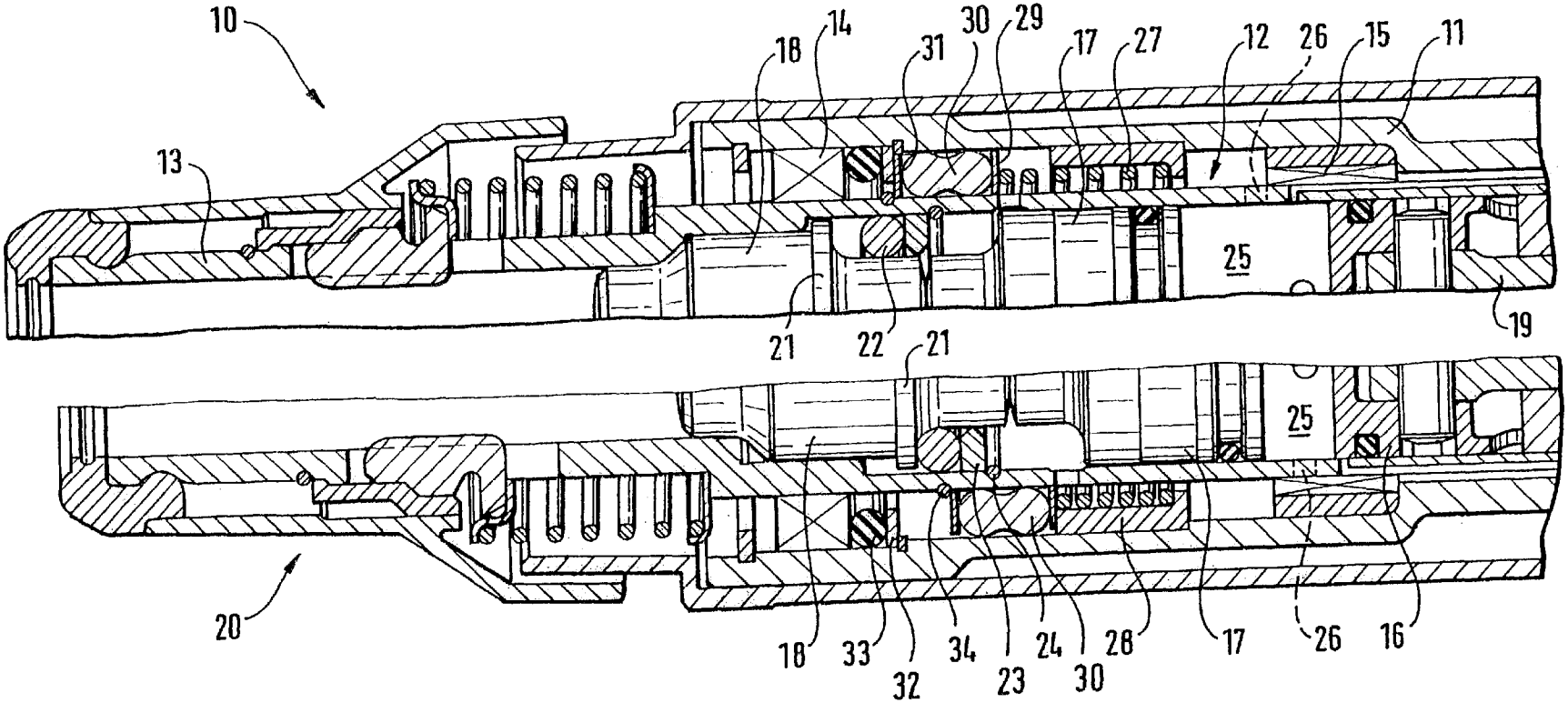
Figure 2:
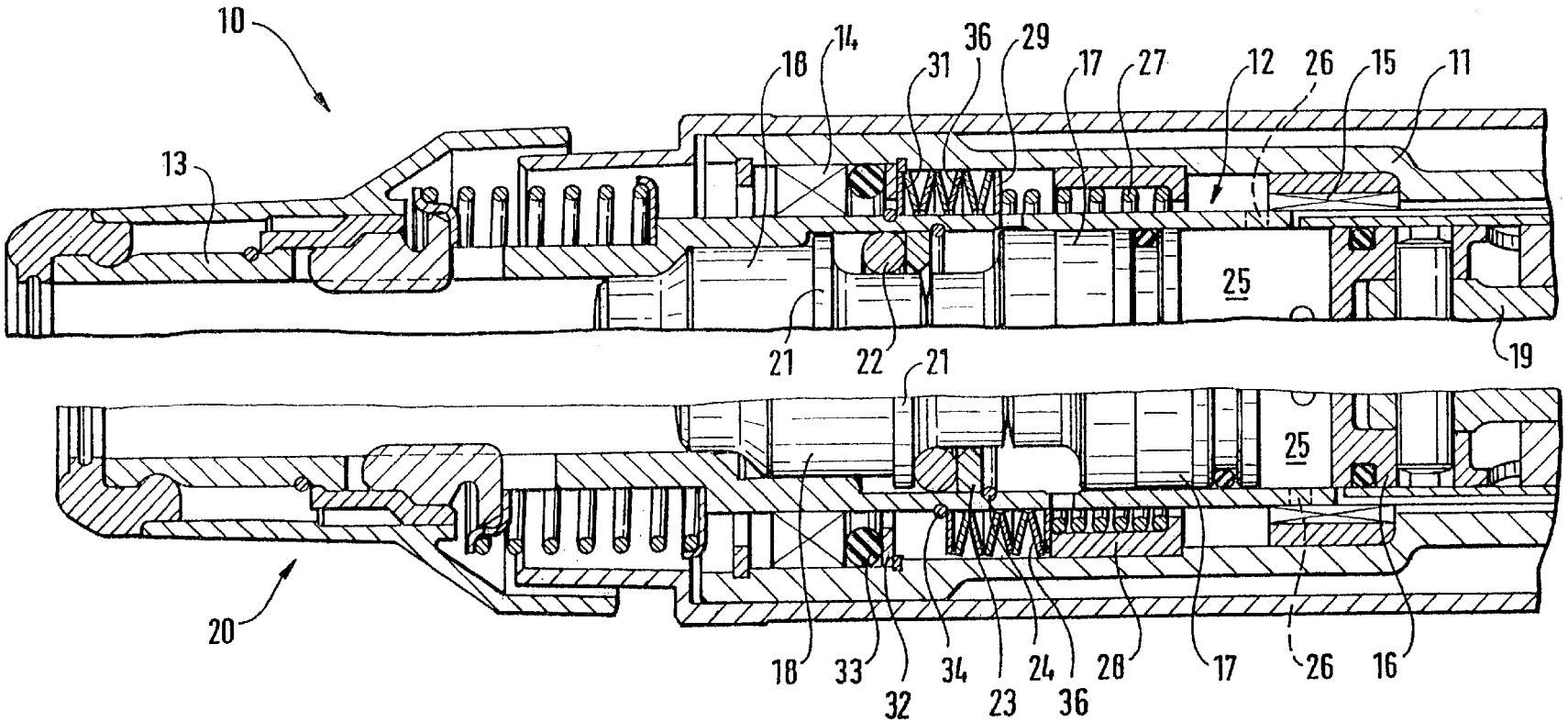
Figure 3:
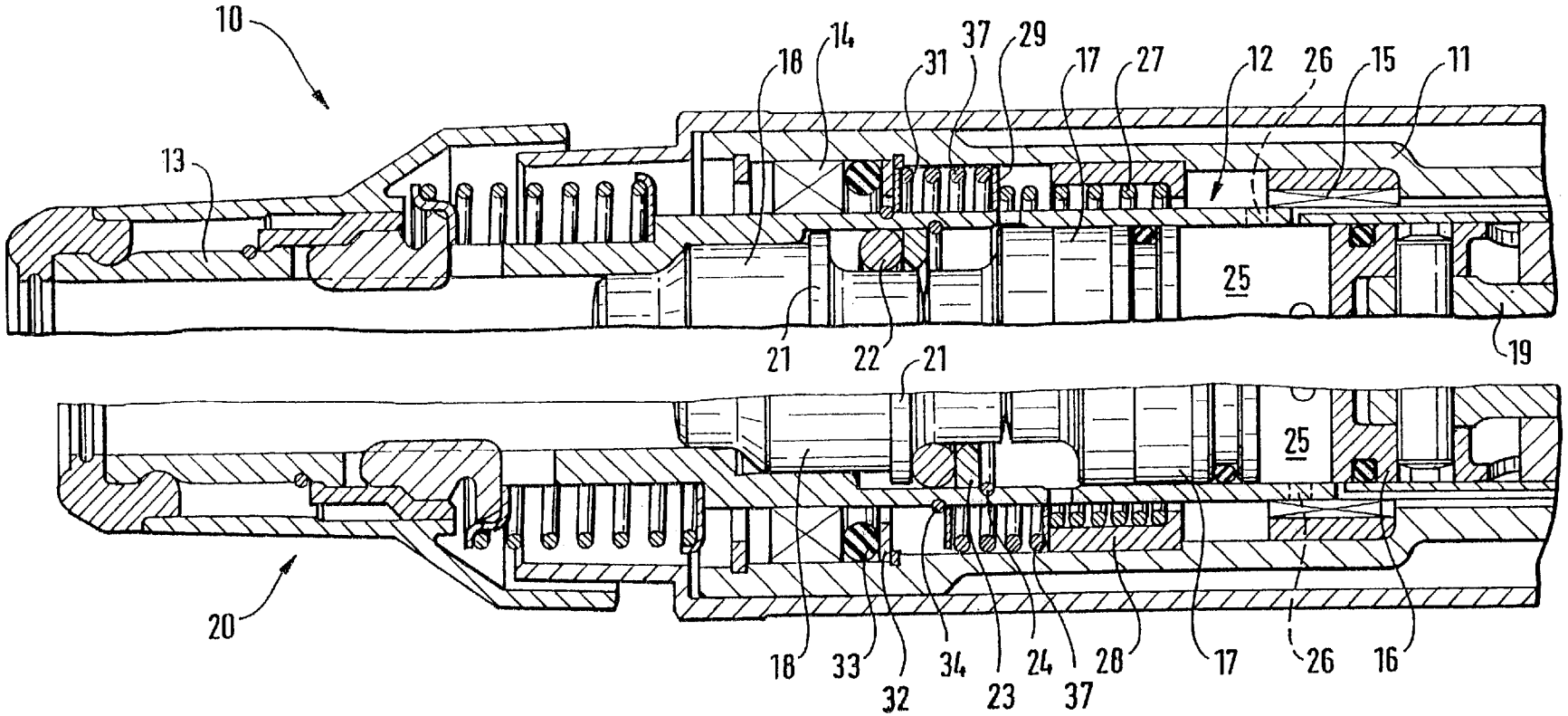

Three exemplary embodiments of the invention are shown in the drawing and described in further detail in the ensuing description. FIGS. 1–3 each show a section through the front part of a drill hammer; in the upper half of each drawing, a half section through the drill hammer is shown in an idling position, while in the lower half of each drawing, a half section through the drill hammer in a hammering position is shown.

DESCRIPTION OF THE EXEMPLARY EMBODIMENTS

In FIG. 1, reference numeral 10 indicates a drill hammer, which has a housing 11 in which a hammering mechanism 12 is accommodated. Inside the housing 11, a guide tube 13 is rotatable in bearing points 14, 15 and is limitedly displaceable axially. The guide tube, in a known manner, holds a piston 16, a striker 17, and a riveting die 18. The piston 16 can be driven to reciprocate via a connecting rod 19. The guide tube 13, on its end remote from the connecting rod 19, forms a tool holder 20 to receive a tool, not shown in detail.

The riveting die 18 is provided with an encompassing collar 21, by way of which it can be braced to the rear, toward the piston 16, via a damping ring 22 and a stop ring 23 as well as a snap ring 24 on the guide tube 13. Between the piston 16 and the striker 17, an air cushion space 25 is formed, which can be ventilated via radial through bores 26 in the guide tube 13. A restoring spring 27, which is braced toward the housing on a bearing ring 28 solidly connected to the housing and toward the guide tube on a disk 29, acts upon the guide tube 13 with a restoring force that is oriented forward, toward the tool holder 20.

In the upper half of FIG. 1, the drill hammer 10 is shown in an idling position, in which the guide tube 13 is forced into a forward outset position by the restoring spring 27, in the direction toward the tool holder 20. The force of the restoring spring 27 is transmitted first to a damping element 30 via the disk 29, which forms a first axial stop toward the guide tube, and then to the guide tube 13, via a retaining disk 31 and a securing ring 34. The retaining disk 31 forms a second axial stop toward the housing. Toward the front, the axial displacement of the guide tube 13 is limited by an annular disk 32, which serves the securing ring 34 as a front stop toward the housing. The annular disk 32 is axially braced in turn on the bearing 14 via an O-ring 33.

In the idling position, the air cushion space 25 is ventilated via the through bores 26, so that no effective air cushion can build up between the piston 16 and the striker 17, and as a result the hammering mechanism 12 is not activated.

In the lower half of FIG. 1, the drill hammer 10 is shown in the hammering position, in which the through bores 26 are radially covered by the bearing 15, so that the air cushion space 25 is sealed off. As a consequence of the reciprocating motion of the piston 16, the result is accordingly a buildup of an air cushion in the air cushion space 25, by way of which the striker 17 can likewise be driven to reciprocate. The striker 17 then acts upon the riveting die 18 with axial impacts, which the riveting die passes on to the tool, not shown in further detail, in the tool holder 20, in the course of which the riveting die 18 experiences reverse impacts, as reaction forces, from the tool in the direction of the hammering mechanism 12. These reverse impacts are transmitted to the guide tube 13 via the damping ring 22, stop ring 23, and snap ring 24.

The guide tube 13 is cushioned from the housing 11 at the back via the restoring spring 27. In the hammering position, however, the restoring spring 27 is compressed so far that the damping element 30, which is separate from the restoring spring 27, is braced toward the housing directly on the bearing ring 28. In this way, the reverse impacts of the riveting die 18, transmitted to the guide tube 13, are absorbed by the housing 11, bypassing the restoring spring 27, and effectively damped by the damping element 30.

The exemplary embodiment of FIG. 2 differs from the exemplary embodiment of FIG. 1 only in that a cup spring assembly 36 is used instead of a damping element 30. All the other parts, as in the third exemplary embodiment in FIG. 3 that follows, are identified by the same reference numerals. Because of the cup spring assembly 36, a longer spring travel of the guide tube 13 after a reverse impact by the riveting die 18 can be attained, compared to the damping element 30 of FIG. 1, and as a result a damping that differs from that of the damping element 30 is attainable.

In the exemplary embodiment of FIG. 3, as the spring and/or damping member between the guide tube 13 and the housing 11, a helical spring 37 is provided, instead of the damping element 30 of FIG. 1 and the cup spring assembly 36 of FIG. 2. With the aid of the helical spring 37, a different spring characteristic can be attained compared to that with cup springs. In this case as well, a reverse impact damping that is independent from the restoring spring 27 is assured in the hammering position.

As an alternative to the exemplary embodiments shown, it is also conceivable to combine a damping element 30 with a cup spring assembly 36 or with a helical spring 37 or with other damping and/or spring members, and this can be done in either a parallel or series connection. The drill hammer 10 can also be embodied purely as a riveter, without a rotational drive of the guide tube 13. The damping and/or spring member 30, 36, 37, which is in addition to the restoring spring 27, can also be embodied by the restoring spring itself instead, if the restoring spring has a nonlinear spring or damping characteristic. What is essential is that in the hammering position of the guide tube 13, the spring and/or damping member between the guide tube 13 and the housing 11 has a spring or damping characteristic that differs from the restoring spring 27 in the region of the idling position of the guide tube.

What is claimed is:

1. A drill hammer or riveter, comprising a housing (11) wherein a hammering mechanism (12) is accommodated in the housing, wherein, in an axially displaceably supported guide tube (13), the hammering mechanism has a reciprocating piston (16) and a striker (17), drivable by means of the piston (16) via an air cushion, wherein the hammering mechanism (12) is moveable out of an idling position into a hammering position by means of an axial displacement of the guide tube (13), wherein the guide tube (13) is urged by a restoring spring (27) in a direction of the idling position with a restoring force, wherein between the guide tube (13) and the housing (11), at least one damping or spring member (30, 36, 37) is provided, wherein, in the hammering position of the guide tube (13), the at least one damping or spring member has either a spring or damping characteristic between the guide tube (13) and the housing (11) that deviates from the restoring spring (27) in the region of the idling position.

2. The drill hammer or riveter or claim 1, wherein the at least one damping spring member (30, 36, 37) is formed by a component embodied separately from the restoring spring (27).

3. The drill hammer or riveter of claim 2, wherein the at least one damping spring member (30, 36, 37), in the hammering position of the guide tube (13), rests on a first axial stop (31), toward the guide tube, and on a second axial stop (29), toward the housing.

4. The drill hammer or riveter of claim 3, wherein the restoring spring (27) is braced on one of the two stops (31, 29) via the at least one damping spring member (30, 36, 37).

5. The drill hammer or riveter of claim 4, wherein the first stop (31), toward the guide tube, is formed by a retaining disk, wherein the retaining disk is secured relative to the guide tube (13) by means of a securing ring (34) against axial displacement frontward in the direction of a tool holder (20).

6. The drill hammer or riveter of claim 5, wherein on the side of the at least one damping spring member (30, 36, 37) remote from the tool holder (20), a stop disk, which simultaneously acts as an abutment toward the guide tube for the restoring spring (27), is provided as the second stop (29).

7. The drill hammer or riveter of claim 6, wherein in the hammering position of the guide tube (13), the stop disk (29) is braced at the back via a bearing ring (28) toward the housing.

8. The drill hammer or riveter of claim 2, wherein an elastomer element (30) is provided as the at least one damping spring member.

9. The drill hammer or riveter of claim 2, wherein a cup spring assembly (36) is provided as the at least one damping spring element.

10. The drill hammer or riveter of claim 2, wherein a helical spring (37) is provided as the at least one damping spring member.

* * * * *